US006780080B2

(12) United States Patent
Horta et al.

(10) Patent No.: US 6,780,080 B2
(45) Date of Patent: Aug. 24, 2004

(54) NARROW PROFILE SOFT TIP FOR UNDERWIRE

(75) Inventors: Joseph Horta, Yonkers, NY (US); Ajit Thakur, Eagleville, PA (US); Sam Roizer, West Nyack, NY (US)

(73) Assignee: S & S Industries, Inc., Long Island City, NY (US)

( * ) Notice: Subject to any disclaimer, the term of this patent is extended or adjusted under 35 U.S.C. 154(b) by 0 days.

(21) Appl. No.: 10/337,597

(22) Filed: Jan. 7, 2003

(65) Prior Publication Data

US 2004/0132379 A1 Jul. 8, 2004

(51) Int. Cl.[7] ..... A41C 3/00
(52) U.S. Cl. ..... 450/41; 2/259; 2/264
(58) Field of Search ..... 450/41, 45, 46, 450/47, 48, 50–52; 2/255–260, 262–264

(56) References Cited

U.S. PATENT DOCUMENTS 3,599,643 A * 8/1971 Schwartz ..... 450/41
3,605,753 A * 9/1971 Schwartz ..... 450/41
3,608,556 A * 9/1971 Paterson ..... 450/48
3,777,763 A * 12/1973 Schwartz ..... 450/52
4,271,580 A * 6/1981 King et al. ..... 450/41
5,830,040 A * 11/1998 Morgan et al. ..... 450/41
5,934,970 A * 8/1999 Morgan et al. ..... 450/41
6,152,802 A * 11/2000 Horta et al. ..... 450/48
6,468,130 B1 * 10/2002 Thakur et al. ..... 450/41

* cited by examiner

*Primary Examiner*—Gloria M. Hale
(74) *Attorney, Agent, or Firm*—Abelman, Frayne & Schwab

(57) ABSTRACT

A narrow profile soft tip is provided for an underwire arcuate member intended to be fitted into a sleeve. The arcuate member has a first width at a shoulder position thereof and the tip has a tip width at a lower surface thereof substantially equal to the first width of the arcuate member, such that the arcuate member and the tip as mounted on the arcuate member with the lower surface adjacent the shoulder position present a smooth profile at the shoulder position.

11 Claims, 2 Drawing Sheets

NARROW PROFILE SOFT TIP FOR UNDERWIRE

FIELD OF THE INVENTION

This invention relates to underwires used in supporting garments. As used herein, the term "supporting garments" is intended to include brassieres, corsets, swim suits, peignoirs and other foundation garments that have breast-supporting cups.

BACKGROUND OF THE INVENTION

Brassieres and similar supporting garments typically include an underwire in the form of a semi-rigid stiffening member of a generally arcuate U-shape that is positioned below the breast cup to provide increased support to the garment. The underwire is placed in an appropriately shaped fabric pocket or sleeve that extends from the central portion and along the lower and outside portions of the breast cup to a position at the wearer's side, under the arm. The resilient underwire of the prior art can be made of a metal, such as steel, having a rectangular, oval or other cross-section, or from polymeric materials in a variety of cross-sectional shapes.

As manufactured, the U-shaped underwire of the prior art has a length "L" defined by a longitudinal axis extending from one end to the other. The underwire also lies flat in an unstressed state, its longitudinal axis lying in a plane. The dimension of the underwire in this plane and perpendicular to the length is the width "W," and the dimension perpendicular to the plane is the depth "D." When fabricated from metal, the underwire will twist when subjected to a torque applied to its ends. A lateral force applied normal to the plane of the longitudinal axis at a point near one end will also produce a twisting or torsional movement of the underwire. As used herein, the term "lateral force" means a force applied in a direction that is normal to the longitudinal axis or plane of the underwire in its flat, unstressed condition.

When assembled in the supporting garment, the outer end or tip portion of the underwire is positioned in a soft fleshy area of the wearer. The ends of the underwire, one of which will generally be along the side of the breast proximate the wearer's arm and the other of which will generally be at the cleavage portion of the breast, distal the wearer's arm, are stiff and rigid and typically include hard corners as manufactured. During movement, the rigid ends of the underwire, and other portions intermediate the ends, can press uncomfortably against or into the wearer at particularly sensitive portions of the wearer's body. This discomfort is most commonly experienced by wearers of larger cupsizes, individuals having a fleshy torso and those engaged in physical activity that includes stretching, turning and twisting the torso.

Accordingly, to minimize the discomfort, the sleeve into which the underwire is fitted is made narrow enough to substantially match the width of the underwire, so that the underwire cannot normally shift out of its intended position. In order to make the sleeve as narrow as possible to prevent shifting of the underwire during wearing, the sleeve is generally no wider than the widest portion of the underwire.

Another practice for alleviating this discomfort is to provide a soft auxiliary cushion tip of plastic or the like at the ends of the underwire. Such cushion tips are described in U.S. Pat. Nos. 5,830,040, 3,777,763 and 3,608,556, and represent efforts to provide greater comfort to the wearers of supporting garments constructed with underwires. Such soft plastic cushion tips for the ends of the underwires have generally achieved commercial and wearer acceptance. However, their presence in the forms available in the prior art creates problems during fabrication.

Specifically, a prior art cushion tip has generally been fitted over the normal end of the underwire and is wider than the underwire, so that it presents a shoulder at its base where it surrounds the underwire. However, the narrow sleeve into which the underwire is fitted is usually made from a soft plushy fabric in order to cushion the feel of the underwire against the wearer's body. Because the sleeve is U-shaped to match the underwire, the underwire must be inserted in a curving motion to be slid into and around the sleeve into position. The shoulder of the cushion tip will often catch on the plushy fabric, particularly if the underwire has to be withdrawn at all in the process of being fitted into the sleeve.

Additionally, the sleeve must be made wider to accommodate the relatively wide cushion tip. Such wider sleeves are generally considered to be unattractive and therefore constitute a significant drawback in a fashionable garment.

SUMMARY OF THE INVENTION

It is therefore an object of the present invention to provide an underwire having a cushion tip that avoids the above-described difficulties of the prior art.

It is another object of the present invention to provide an underwire cushion tip that may be used with narrower casings or sleeves.

The above and other objects are achieved by the present invention which, in one embodiment, is directed to a narrow profile soft tip for an underwire arcuate member intended to be fitted into a sleeve, where the arcuate member has a first width W at a shoulder position thereof and the tip has a second width Wt at a lower surface thereof substantially equal to the first width W of the arcuate member, such that the arcuate member and the tip as mounted on the arcuate member with the lower surface adjacent the shoulder position present a smooth profile at the shoulder position.

In another embodiment, the present invention is directed to a narrow profile soft tip for an underwire arcuate member intended to be fitted into a sleeve, where the arcuate member has first and second ends, a length L defined by a longitudinal axis extending from the first end to the second end and lying in a plane, and a first width W at a first shoulder position at the first end in the plane and perpendicular to the length, the first end having a narrowed first end portion extending beyond the first shoulder position with an end width We less than the first width W. The tip then has a wall surrounding a central cavity open at a lower surface sized to fit over the first end portion, the tip also having an exterior width Wt at the lower surface substantially equal to the first width W of the arcuate member, such that the arcuate member and the tip as mounted on the first end portion with the lower surface adjacent the first shoulder position present a smooth profile at the first shoulder position.

In a preferred embodiment, the second end has the same structure and is fitted with another tip in accordance with the present invention.

In another aspect of the present invention, an underwire for supporting garments includes the arcuate member as defined above having the advantageous tips fitted over the end portions.

In yet another aspect of the present invention, a supporting garment is provided with the novel underwire with cushion tips.

These and other objects, features and advantages of the present invention will be apparent from the following detailed description of the preferred embodiments taken in conjunction with the following drawings, wherein like reference numerals denote like elements.

DETAILED DESCRIPTION OF THE PREFERRED EMBODIMENTS

Figure 1:
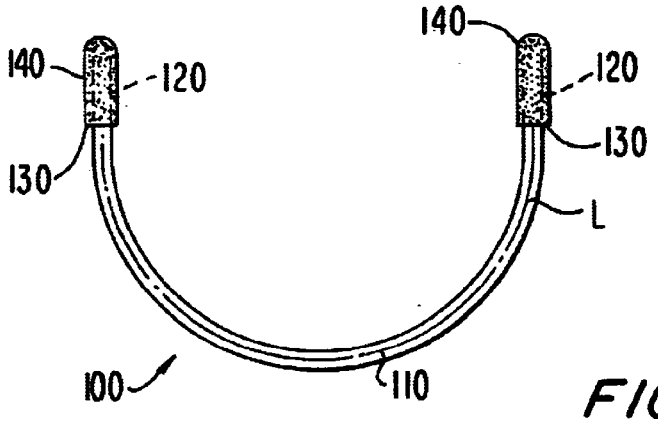
FIG. 1 PRIOR ART
FIG. 1 is a top plan view of a typical prior art underwire assembly that is fitted with cushion tips.

An exemplary embodiment of an underwire assembly of the prior art is shown in FIG. 1, designated generally by the reference numeral 100. The arcuate member 110 has a longitudinal axis "L" and a width perpendicular thereto lying in the plane of curvature (i.e. the plane of the drawing). The width of the arcuate member 110 taken along substantially the entire longitudinal axis is uniform. The opposing ends 120 are fitted with cushion tips 140. Some departure from the uniform cross-section may appear at the ends 120 in order to accommodate mounting of the tips 140. For example, it is known to provide one or more perforations at one or both ends of the arcuate member 110 for slidably or pivotally mounting the soft tip 140. However, in the prior art, the width of the tips 140 is substantially broader than the width of the arcuate member 110 itself where the tip 140 meets the arcuate member 110. This presents a shoulder 130 that can snag on the fabric of the sleeve into which the underwire assembly 100 is fitted, causing the difficulties in assembly discussed above.

Figure 2:
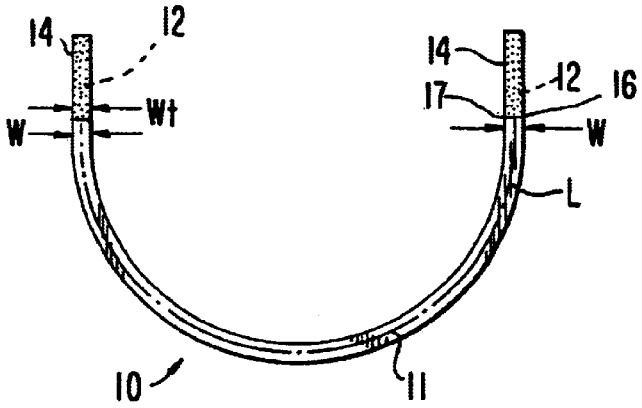
FIG. 2 is a top plan view of an improved underwire in accordance with a preferred embodiment of the present invention.

Referring now to FIG. 2, there is depicted one embodiment of the improved underwire in accordance with the present invention, designated generally by the reference numeral 10. As in the prior art, the underwire 10 includes an arcuate member 11 having a longitudinal axis "L" and a width "W" perpendicular thereto lying in the plane of curvature. The dimension perpendicular to the plane is the depth "D."

Figure 3:
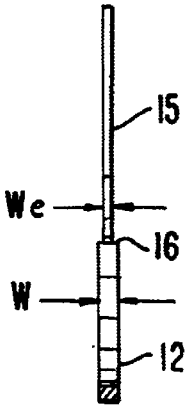
FIG. 3 is a side view of one end of the underwire of FIG. 2.

In accordance with an advantageous aspect of the present invention, the width of the arcuate member 11 is uniform at most only along the center portion *of the longitudinal axis. In this embodiment, at each of the opposing ends 12, an end portion 15 extends beyond a shoulder position 16 and has a width We narrower than the width W, as shown in FIG. 3. The end portions 15 are narrower in order to be fitted with cushion tips 14 formed in accordance with the present invention.

Figure 4:
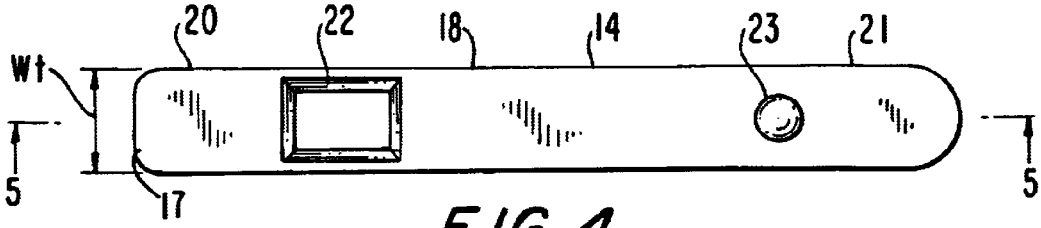
FIG. 4 is a top plan view of an improved cushion tip for an underwire in accordance with a preferred embodiment of the present invention.
Figure 5:
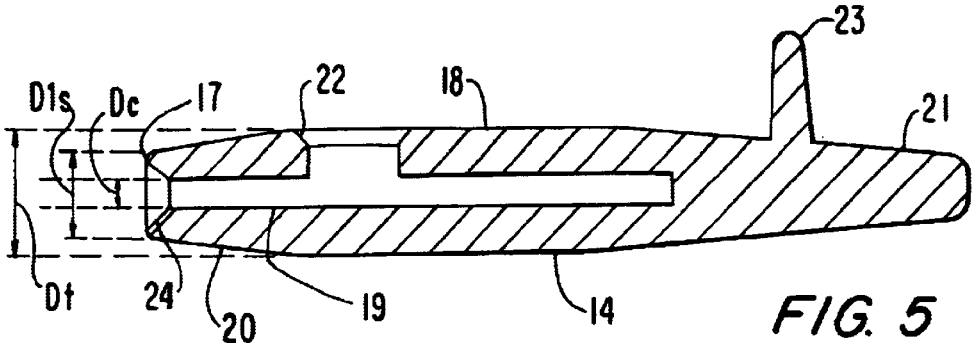
FIG. 5 is a cross-sectional view taken along section line 5—5 of FIG. 4.

The tips 14, which are advantageously identical in structure, are shown in FIGS. 4 and 5 to be formed generally in the shape of a cap that fits over the end portions 15. Each tip 14 has a lower surface 17 at a proximal portion 18 including a central cavity 19 (see FIG. 5) with a central opening 24 surrounded by a wall 20. A distal portion 21 of the tip 14 has a rounded end and presents a smooth cover for the very end of the arcuate member 11.

The cavity 19 is at least as long as the end portion 15, so that the tip 14 may be fitted over the end portion 15 with its lower surface 17 at the shoulder position 16. In accordance with this advantageous aspect of the present invention and as shown in FIGS. 2 and 4, the width Wt of the tip 14 at the lower surface 17 is substantially equal to W, the width of the arcuate member 11 at the shoulder position 16. The narrowed width We of the end portion 15 accommodates the widths (thicknesses) of the two portions of the surrounding tip wall 20 to create a smooth linear profile. Therefore, when the tip 14 is fitted down onto the end portion 15 until the lower surface 17 is in contact with the shoulder position 16, the width of the arcuate member 11 and the width of the tip 14 substantially match, creating a smooth profile that will not catch on the fabric of the sleeve into which it will be fitted.

Moreover, this structure means that in the width direction, the underwire 11 as a whole is uniform and as narrow as desired, so that the sleeve in the supporting garment may be correspondingly uniform and narrow, this also providing increased comfort to the wearer without the underwire 11 shifting about.

The tip 14 may be mounted on the end portion 15 in any effective way. For example, the end portion 15 could be made similarly narrow in the depth direction D and/or the tip 14 could be molded to fit tightly thereover, being held to the end portion 15 by a frictional fit. However, given the relatively small dimensions of an underwire and the need to make it flexible, such a structure could result in the end portion 15 being too fragile and subject to breaking off.

Therefore, in accordance with a preferred embodiment of the present invention, the end portion 15 is not narrowed in the depth direction, or at least not so substantially narrowed, and the tip 14 is deepened somewhat in this dimension so as to accommodate the end portion 15 and a mounting structure.

These features are illustrated in FIGS. 4 and 5. FIG. 4 is a top plan view of the tip 14 in its state before it is mounted on the end portion 15 and FIG. 5 is a cross-sectional view of the tip 14 of FIG. 4 taken along line 5—5.

As shown in FIG. 4, the tip 14 has a uniform width Wt and a lower surface 17. Above the lower surface 17 but still in the proximal portion 18 through which the end portion 15 will extend, a window 22 is made through the wall 20 into the central cavity 19. At the distal portion 21, the tip 14 is provided with a projecting pin 23 that may be grasped, by machine or by hand, for manipulating the tip 14, e.g. when affixing the tip 14 to the arcuate member.

As shown in FIG. 5, the central cavity 19 has the opening 24 at its lower surface 17 through which the end portion 15 may be inserted. The cavity 19 extends only through the proximal portion 18, leaving the distal portion 21 solid for strength. The pin 23 extends from this solid portion.

The depth De of the end portion 15 advantageously matches the size Dc of the cavity 19 in this dimension, or is slightly smaller, and the width We of the end portion 15 advantageously matches the size of the cavity 19 in this dimension, or is slightly smaller, On the other hand, the opening 24 is smaller than at least one of these dimensions. Accordingly, the tip 14 can be slid onto the end portion 15 only until the lower surface 17 meets the shoulder portion 16.

In a preferred embodiment, to hold the tip 14 in place, glue is introduced through and around the window 22, preventing the tip 14 from coming off of the end portion 15.

In order to provide sufficient strength, the total depth Dt of the tip 14 around the window 22 has been found to be advantageously somewhat greater than W. However, the tip 14 is advantageously beveled at its lower surface 17 so that its depth Dls at the lower surface 17 substantially matches the depth of the underwire 11. Therefore, there is no shoulder in this direction either.

Other methods may be used to attach a cushion tip in accordance with the present invention to a suitable underwire arcuate member. For example, a press set fitting may be made by fitting the cushion tip tightly over the end of the arcuate member, or the cushion tip could be molded directly onto the end. In another method, the cushion tip can be attached by sonic sealing, wherein ultrasonic waves are used to seal the metal of the arcuate member to the plastic of the cushion tip. Any other appropriate method may be used depending upon the application.

The tips 14 are made of a soft material, such as a soft plastic or polymeric material, so as to cover the metal of the arcuate member 11 at the end portions. The lips can be fixed or movably mounted and can be configured and fitted or applied to the ends of the underwire in accordance with any of the materials and methods now known and utilized in the prior art, as disclosed above or that may be developed in the future.

Figure 6:
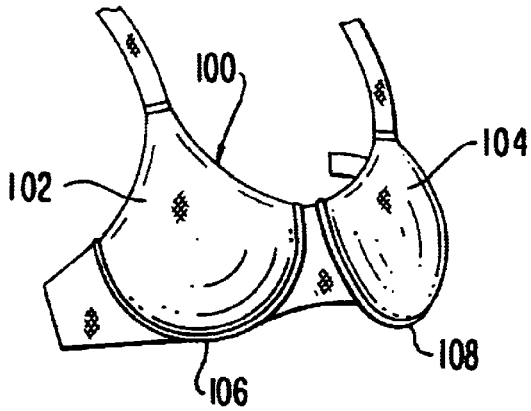
FIG. 6 is a perspective view of a supporting garment with an improved underwire in accordance with the present invention.

FIG. 6 is a view of a supporting garment 100 having breast cups 102, 104 with corresponding sleeves 106, 108 underneath. A respective underwire (not illustrated) in accordance with the present invention has been fitted into each sleeve 106, 108. The novel cushion tips (not illustrated) on the underwires are lighter and smaller than those of the prior art, and the sleeves 106, 108 may be made narrower for a more aesthetically pleasing look while at the same time there will be no snagging of the underwires during insertion into the sleeves.

While the disclosed structure and apparatus have been particularly shown and described with respect to the preferred embodiments, it is understood by those skilled in the art that various modifications in form and detail may be made therein without departing from the scope and spirit of the invention. Accordingly, modifications such as those suggested above, but not limited thereto are to be considered within the scope of the invention, which is to be determined by reference to the appended claims.

We claim:

1. A narrow profile soft tip for an underwire arcuate member intended to be fitted into a sleeve, where the arcuate member has a first width at a shoulder position thereof and a thickness in a direction transverse to the width, said tip having a tip width at a lower surface thereof substantially equal to the first width of the arcuate member, such that the arcuate member and said tip as mounted on the arcuate member with said lower surface adjacent the shoulder position present a smooth profile in the widthwise direction at the shoulder position, and the lower end portion of the tip is tapered in the thickness direction toward the arcuate member.

2. An underwire assembly comprising:

an underwire arcuate member intended to be fitted into a sleeve and having opposing ends; and a respective narrow profile soft tip fitted on each of said ends, where said arcuate member has a first width at a respective shoulder position thereof at each end and a thickness in a direction transverse to the width, and each said tip has a tip width at a lower surface thereof substantially equal to said first width of said arcuate member, such that said arcuate member and each said tip as mounted on said arcuate member with the respective lower surface adjacent the respective shoulder position present a smooth profile in the widthwise direction at each shoulder position, and the lower end portion of each tip is tapered in the thickness direction toward the arcuate member.

3. A narrow profile soft tip for an underwire intended to be fitted into a sleeve, where the underwire has an arcuate member with first and second ends, a length defined by a longitudinal axis extending from the first end to the second end and lying in a plane, and a first width at a first shoulder position adjacent the first end in the plane and perpendicular to the length, the first end having a narrowed first end portion with an end width less than the first width, and a thickness in a direction perpendicular to the width, wherein said tip comprises a wall surrounding a central cavity open at a lower surface sized to fit tightly over the first end portion, said tip having an exterior width at said lower surface substantially equal to the first width of the arcuate member, such that the arcuate member and said tip as mounted on the first end portion with said lower surface adjacent the first shoulder position present a smooth profile in the widthwise direction at the first shoulder position, and the lower end portion of each tip is tapered in the thickness direction toward the arcuate member.

4. The tip of claim 3, wherein the arcuate member has the first width at a second shoulder position adjacent the second end in the plane and perpendicular to the length, the second end having a narrowed second end portion with the end width less than the first width, such that the arcuate member and said tip as mounted on the second end portion with said lower surface adjacent the second shoulder position present a smooth profile at the second shoulder position.

5. The tip of claim 4, wherein the end portions of the arcuate member are substantially flat in the plane, said cavity of said tip being generally rectangular in cross-section to fit tightly on either of said end portions.

6. The tip of claim 3, wherein said tip is made of a soft polymer.

7. The tip of claim 3, wherein the first end portion of the arcuate member is substantially flat in the plane, said cavity of said tip being generally rectangular in cross-section to fit tightly on the first end portion.

8. An underwire for use in supporting garments, comprising:

a generally U-shaped arcuate member having first and second ends, a length defined by a longitudinal axis extending from said first end to said second end and lying in a plane, and a first width at a respective shoulder position adjacent said first and second ends in the plane and perpendicular to said length, each of said first and second ends having a respective narrowed end portion with an end width less than the first width, and a thickness in a direction generally perpendicular to the first width, and a narrow profile soft tip fitted on each of said first and second end portions, each said tip having an exterior width at its lower surface substantially equal to said first width of said arcuate member, such that said arcuate member and each said tip as mounted on the respective end portion with the respective lower surface adjacent the respective shoulder position present a smooth profile in the widthwise direction at the respective shoulder position, and the proximal end portion of the tip is tapered in the thickness direction toward the arcuate member.

9. The underwire of claim 8, wherein said end portions of the arcuate member are substantially flat in the plane, each said tip having a cavity that is generally rectangular in cross-section to fit tightly on the respective end portion.

10. The underwire of claim 8, wherein each said tip is made of a soft polymer.

11. A supporting garment, comprising:

first and second breast cups;

first and second sleeves respectively positioned under said breast cups; and an underwire in each of said first and second sleeves, wherein each underwire includes:

a generally U-shaped arcuate member having first and second ends, a length defined by a longitudinal axis extending from said first end to said second end and lying in a plane, and a first width at a respective shoulder position adjacent said first and second ends in the plane and perpendicular to said length, and a thickness in a direction generally perpendicular to the width, each of said first and second ends having a respective narrowed end portion with an end width less than the first width, and a narrow profile soft tip fitted on each of said first and second end portions, each said tip having an exterior width at its lower surface substantially equal to said first width of said arcuate member, such that said arcuate member and each said tip as mounted on the respective end portion with the respective lower surface adjacent the respective shoulder position present a smooth profile in the widthwise direction at the respective shoulder position, and the lower end portion of each said tip is tapered in the thickness direction toward the arcuate member, wherein each of said first and second sleeves has an inner width substantially matching said first width.

* * * * *